8/9/83 OR 4,398,200

United States Patent [19]

Meier

[11] 4,398,200

[45] Aug. 9, 1983

[54] FEED APERTURES WITH CROSSPOLARIZATION COMPENSATION FOR LINEAR POLARIZATION

[75] Inventor: Raymond J. Meier, King of Prussia, Pa.

[73] Assignee: General Electric Co., Philadelphia, Pa.

[21] Appl. No.: 319,389

[22] Filed: Nov. 6, 1981

Related U.S. Application Data

[63] Continuation of Ser. No. 168,361, Jul. 10, 1980, abandoned.

[51] Int. Cl.[3] ..... H01Q 19/13; H01Q 13/02

[52] U.S. Cl. ..... 343/756; 343/779; 343/786

[58] Field of Search ..... 343/756, 797, 779, 783, 343/786

[56] References Cited

U.S. PATENT DOCUMENTS

| | | | |
|---|---|---|---|
| 2,712,067 | 6/1955 | Kock | 343/783 |
| 3,031,664 | 4/1962 | Wielobob | 343/756 |
| 4,042,935 | 8/1977 | Ajioka et al. | 343/797 |
| 4,109,253 | 8/1978 | Chu | 343/756 |
| 4,115,782 | 9/1978 | Han et al. | 343/779 |

FOREIGN PATENT DOCUMENTS

| | | | |
|---|---|---|---|
| 949493 | 9/1956 | Fed. Rep. of Germany | 343/783 |

*Primary Examiner*—Eli Lieberman

*Attorney, Agent, or Firm*—Allen E. Amgott

[57] ABSTRACT

The crosspolarization components radiated by adjacent orthogonally linearly polarized feed horns of a reflector antenna system are compensated by structural modifications incorporated in the feed horns. In a first embodiment, the modified feed horns have curved walls and included shaped septa. Other embodiments involve the use of shaped walls or shaped septa only. In the case of an offset reflector, asymmetric modifications of the wall shape and septa are employed. For flared feed horns with rectangular cross section, the crosspolarization compensation is provided by curving the forward edges of the horn walls convexly or concavely as required.

40 Claims, 16 Drawing Figures

FEED APERTURES WITH CROSSPOLARIZATION COMPENSATION FOR LINEAR POLARIZATION

BACKGROUND OF THE INVENTION

This is a continuation of co-pending U.S. patent application Ser. No. 06/168,361-Meier filed July 10, 1980, now abandoned, and assigned to the assignee of the instant application.

FIELD OF THE INVENTION

This invention relates to reflector antenna systems and, more particularly, to multibeam reflector antenna systems having cross-polarization compensation for linear polarization.

DESCRIPTION OF THE PRIOR ART

In multibeam antenna systems, multiple waveguide elements, or as used hereinafter feed horns are used in the focal region of a single reflector to produce a cluster of simultaneous multiple beams. If some of these beams use orthogonal polarizations in the same frequency band, a high degree of polarization purity with low crosspolarization is required to provide adequate signal suppression in adjacent beam footprint regions. In the prior art, the reduction of crosspolarization in reflector antennas has been accomplished by using a large F/D (focal length to diameter) ratio, by gridding the reflector or by using separate polarization screens or grids in front of the feed horn or in front of the entire reflector/-feed horn assembly. For example, D. T. Nakatani and G. G. Kuhn in "Comstar I Antenna System," *Digest International Symposium IEEE Antennas and Propagation Society,* June 20–22, 1977, Stanford, California, (Ap-S Session 12, 0900, Tuesday, June 21) pp. 337–340, describe the use of polarizing screens placed in the aperture plane in front of each reflector to obtain polarization purity. These screens are formed of a parallel grating of conducting strips which are fabricated as a sandwich of aluminized Kapton.

The prior art systems for reducing crosspolarization, which require a relatively large F/D ratio, do not permit the use of a compact overall configuration with lower weight. The use of gridded reflectors or screens increases the weight and cost of the antenna system. Due to the need to provide room for the grids or screens, these prior art systems are not well suited for multibeam applications. Although the screens used by Nakatani and Kuhn are designed to provide low insertion loss, some loss is nevertheless present.

SUMMARY OF THE INVENTION

It is therefore the object of the present invention to provide improved means for compensating for crosspolarization which overcomes the drawbacks of the prior art systems.

To this end, the invention contemplates the incorporation of crosspolarization compensation means in the structure of the feed horn itelf. In one form of the invention, the compensation is provided by modifying the feed horn to have curved walls and septa which are empirically chosen to provide the proper amount of compensation. In a second form of the invention, the compensation is provided by employing shaped septa in a feed horn having straight, unmodified walls, the septa curvature being chosen to provide the necessary compensation of the crosspolarization components. The compensation may also be provided by a feed horn having curved walls and no septa. In the case of feed horns which are tilted with respect to the axis of the reflector, the compensation is provided by an asymmetric feed horn having curved septa and feed walls. The amount of asymmetry and the curvature of the walls and septa are chosen to provide the required compensation. For the case of feed horns having planar walls and a rectangular cross section normal to the horn axis which increases along the length of the horn, the crosspolarization compensation is provided by curved forward edges of the horn walls, the edges being convex for one type of compensation and concave for compensation in an opposite direction.

Additional objects, advantages and features of the invention will become more readily apparent from the following detailed description of preferred embodiments of the invention when considered in conjunction with the accompanying drawings.

DETAILED DESCRIPTION

Figure 1:
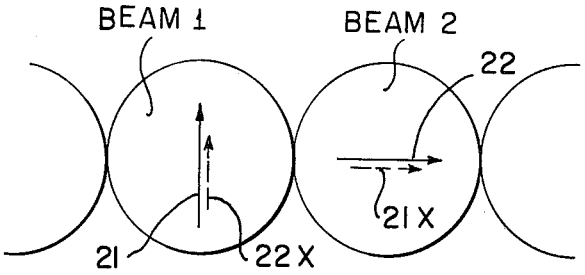
FIG. 1 is a diagram illustrating the presence of crosspolarization components in adjacent beam footprints of adjacent orthogonally polarized beams.

As illustrated in FIG. 1, two adjacent beams, Beam 1 and Beam 2, of a multibeam reflector antenna system of the prior art include signals in the same frequency band. These signals, are radiated simultaneously at a single reflector by a pair of feed horns of a set of multiple feed horns located in the focal region of the reflector and positioned adjacent each other with the feed horn axes pointed at the reflector. The radiated beams are orthogonally polarized as indicated by the vertically polarized signal component 21 in Beam 1 and the horizontally polarized component 22 in Beam 2. Each of these polarizations is sometimes referred to as the dominant linear polarization of the beam. The reflected beams are radiated by reflector/feed horn assemblies of the prior art which inherently radiate a crosspolarization component. Thus, when vertically polarized Beam 1 is radiated, it includes a spurious horizontally polarized component of lower amplitude, some of which will appear as a horizontal crosspolarization component 21× in Beam 2. Likewise, when horizontally polarized Beam 2 is radiated, it includes a spurious vertically polarized component of lower amplitude, some of which appears as a vertical crosspolarization component 22× in Beam 1. A portion of the signal intended for Beam 1 thus appears in Beam 2 and vice versa, resulting in inadequate signal separation. It is therefore desirable to improve the polarization purity and reduce the crosspolarization of the adjacent orthogonally polarized beams to provide adequate signal suppression in adjacent beam footprint regions.

Figure 2A:
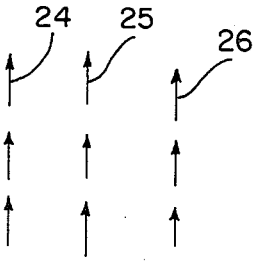
FIG. 2*a* is a diagram showing the required parallel polarization lines for zero crosspolarization with a symmetrical reflector.
Figure 2B:
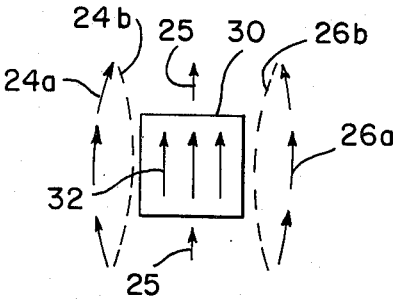
FIG. 2*b* is a diagram showing the curved polarization lines of a typical, uncompensated feed horn with a symmetrical reflector.

FIG. 2A illustrates the desired polarization condition which results in no crosspolarization. Each of the vertically polarized (in this case) lines 24, 25 and 26 are parallel and have no lateral components. However, as shown in FIG. 2*b*, a typical, uncompensated feed horn 30 of the prior art radiates the vertically polarized signal 32 as a set of polarization lines, some of which are curved and thus include crosspolarization components. Depending on the reflector geometry, the F/D ratio, the feed horn size and the feed horn shape, the outer polarized lines may be convex, as shown by lines 24*a* and 26*a*, or concave, as shown by dash lines 24*b* and 26*b*. For a given reflector geometry there may exist an uncompensated feed horn which provides parallel polarization lines. However, such a feed horn will not, in general, coincide with the feed horn required to provide acceptable antenna efficiency and radiation characteristics.

Figure 2C:
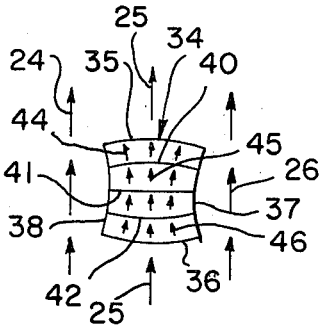
FIG. 2*c* is a diagram showing a feed horn modified in accordance with a first embodiment of the invention to compensate for crosspolarization with a symmetrical reflector.

According to the present invention, the feed horns themselves are structurally modified to provide the required polarization line (E-field) compensation. The standard feed horn is, for example, modified to include curved feed horn walls, curved septa within the horn, or both. In the embodiment shown in FIG. 2*c*, modified feed horn 34 includes curved feed horn walls 35, 36, 37 and 38, of which opposed walls 35 and 36 are convex and opposed walls 37 and 38 are concave. A set of spaced septa 40, 41 and 42 extend across feed horn 34. Septa 40 and 42 are curved, while the central septum 41 is generally straight. The spacing and number of septa are selected to cut off all but the fundamental linear polarization mode. The septa are spaced somewhat less than ½ the free space wavelength; the number of septa is determined by the size of the feed horn opening. The curvature of the feed horn walls and the septa may be selected empirically and/or analytically to produce appropriate curvature of the field lines 44, 45 and 46 in the horn to compensate the radiated curved polarized lines 24*a* or 24*b* and 26*a* or 26*b* of FIG. 2*b* and produce the desired straight polarization lines 24, 25 and 26 as seen in FIG. 2*c*. The transformation (or mapping) of the feed polarization into the reflector aperture can be visualized by comparing the polarization lines of FIGS. 2*b* and 2*c*. Although the embodiment shown in FIG. 2*c* is vertically polarized, for reasons of geometric symmetry, the feed horn modification shown in FIG. 2*c* is applicable also for horizontally polarized waves by rotating the feed horn as seen in FIG. 2*c* by 90° about the reflector axis.

Figure 3:
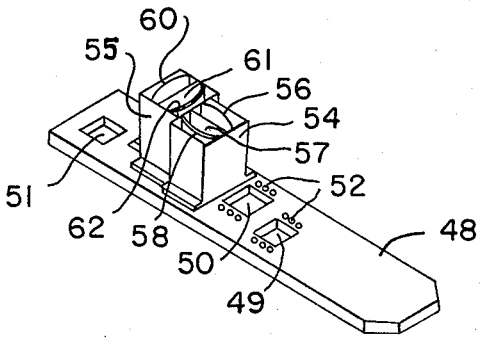
FIG. 3 is a perspective view of a partially assembled set of feed horns showing two adjacent feed horns modified in accordance with a second embodiment of the invention.

A partial assembly of a set of feed horns of a multibeam reflector antenna system is shown in FIG. 3 in which a pair of feed horns 54 and 55 are illustrated positioned so that their forward openings are adjacent each other. A mounting plate 48 includes a plurality of holes for the feed horns; only holes 49, 50 and 51 are visible in the figure. The feed horns are mounted over these openings and secured in place by means of mounting screws 52. Two adjacent feed horns 54 and 55 are shown mounted on board 48. These horns have straight walls but are modified in accordance with the invention by the inclusion of septa, some of which are curved to compensate for the cross-polarization components. Thus, feed horn 54 contains a curved septum 56, a generally straight septum 57 and a curved septum 58. These are so spaced and curved that the radiated polarized wave is compensated for crosspolarization components. The orthogonally polarized adjacent feed horn 55 also includes three septa 60, 61 and 62; of these septa 60 and 62 are curved, while septum 61 is generally straight. Again, the septa are so spaced and curved that the wave radiated by feed horn 55 is compensated for crosspolarization components.

Figure 4:
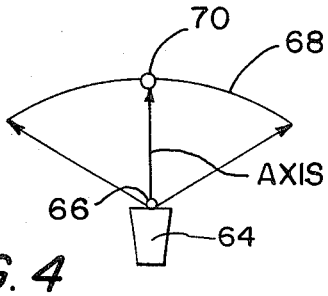
FIG. 4 is a diagram which illustrates the feed horns of the embodiments of FIGS. 2*c* and 3 arranged symmetrically with respect to the axis of a reflector.

The embodiments shown in FIGS. 2*c* and 3 are intended for use in a feed arrangement which is symmetrically positioned with respect to the parabolic reflector. Referring to FIG. 4, the set of feed horns are indicated at 64, the feed horns extend axially of reflector 68. The axis of the set of feed horns, the focal point 66 of the reflector and the vertex 70 of the reflector are generally in alignment.

Figure 5A:
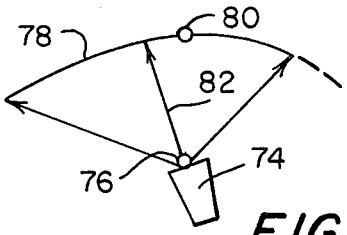
FIGS. 5*a* and 5*b* are diagrams showing offset reflector feed horns for horizontal and vertical polarizations.
Figure 5B:
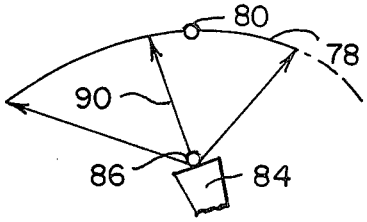

In the case of an offset reflector, somewhat different modifications are required. FIGS. 5*a* and 5*b* show, respectively, offset feed horns for horizontally and vertically polarized waves. In FIG. 5*a*, the feed horn 74 is located at the focal point 76 of the reflector but is tilted towards the center of the offset aperture of reflector 78 to provide symmetrical reflector illumination. The axis of feed horn 74 no longer is aligned with focal point 76 and vertex 80 of reflector 78. In like mannr, the feed horn 84 in FIG. 5*b* is located at the focal point 86 of reflector 78 but is tilted towards the center of the offset aperture of reflector 78. Again, the axis of horn 84 is not aligned with focal point 86 and the vertex 80 of reflector 78. In compensating such offset reflector arrangements for crosspolarization, it is not sufficient to tilt the feed, as compensated for a symmetrical reflector; the polarization line orientation must be maintained with respect to the principal planes of the reflector.

Figure 6A:
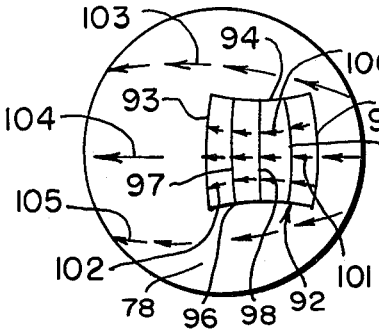
FIGS. 6*a* and 6*b* are diagrams illustrating why feed horns compensated for a symmetrical feed with horizontal and vertical polarizations, respectively, fail to compensate fully for the crosspolarization components of tilted feeds.

The problem is illustrated in FIG. 6*a* for the horizontally polarized wave. A feed horn 92 is compensated in the manner suitable for a symmetrical reflector with curved feed horn walls 93, 94, 95 and 96 and curved septa 97 and 99 on opposite sides of generally straight septum 98 to produce field lines 100, 101, and 102 suitable for compensating the crosspolarization components for the symmetrical reflector. Due, however, to the tilt of feed horn 92 and its asymmetric relation to reflector 78, the resulting radiated wave includes curved polarization lines 103 and 105 on opposite sides of a generally straight polarization line 104. Accordingly, the problem of cross-polarization will remain.

Figure 6B:
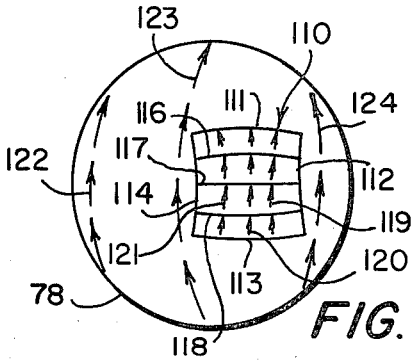

The same situation applies with respect to the vertically polarized arrangement of FIG. 6*b* in which feed horn 110 is compensated for a symmetrical reflector by suitably curving feed horn walls 111, 112, 113 and 114 and by including septa 116, 117, and 118, of which septa 116 and 118 are curved. The field lines 119, 120 and 121 in feed horn 110 are suitable for compensating the crosspolarization components for the symmetrical reflector. Again, the resulting radiated wave includes curved polarization lines 122, 123 and 124 with the problem of crosspolarization remaining.

Figure 7A:
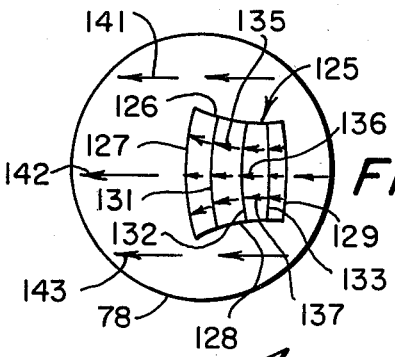
FIGS. 7*a* and 7*b* are diagrams showing the asymmetric modifications of the feed horns for horizontal and vertical polarizations, respectively, to provide proper compensation of the crosspolarization components for offset reflectors.
Figure 7B:
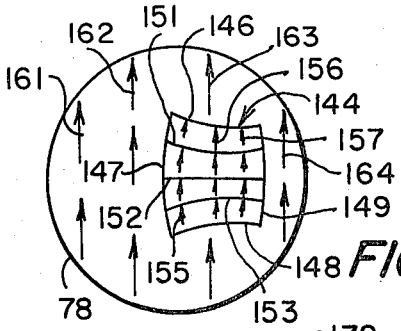

In order to maintain the polarization line orientation with respect to the principal planes of the reflector when the feed horn axes are offset from the reflector vertex, the modifications shown in FIGS. 7*a* and 7*b* are employed. In FIG. 7*a,* feed horn 125 is modified to bring the polarization line orientation asymmetrical with respect to the feed horn center. The arrangement of curved walls 126, 127, 128 and 129 is now asymmetrical with wall 127 near the center of reflector 78 much longer than wall 129 near one edge of the reflector. The pattern of the septa is also changed. The two septa 131 and 132 closest to the center of the reflector are both curved, while septum 133 closest to the edge of the reflector is generally straight. The field lines 135, 136 and 137 within feed horn 125 are not properly shaped to compensate for the crosspolarization components, and the radiated lines 141, 142 and 143 are now straight and parallel.

Unlike the situation applying for the symmetrical reflector arrangements, it is no longer possible simply to rotate the feed horn 90° to provide for the vertically polarized beam. Due to the asymmetry, as shown in FIG. 7*b,* the modifications of the feed horn 144 for the vertically polarized wave are different. Curved feed horn walls 146, 147, 148 and 149 are again asymmetrical with wall 147 near the center of reflector 78 longer than wall 149 near the edge of the reflector. Septa 151 and 153 are curved asymmetrically and center septum 152 is generally straight. The curvature of the feed horn walls and the spacing and curvature of the septa are such that vertically polarized field lines 155, 156 and 157 in feed horn 144 compensate for the crosspolarization components; and feed horn 144 radiates a vertically polarized wave having straight & parallel polarization lines 161, 162, 163 and 164.

Figure 8A:
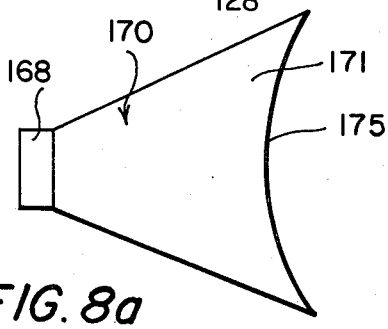
FIGS. 8*a* and 8*b* are diagrams showing a side elevation and an end view, respectively, of a feed horn having planar walls and a rectangular cross section of increasing area and having one type of edge modification.
Figure 8B:
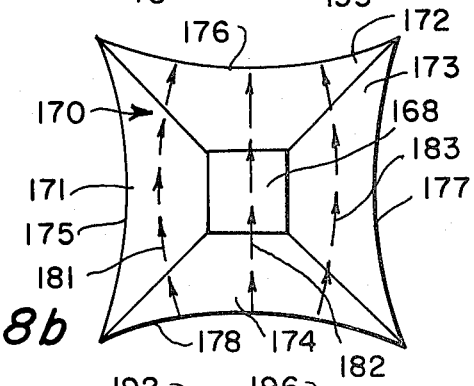
Figure 9A:
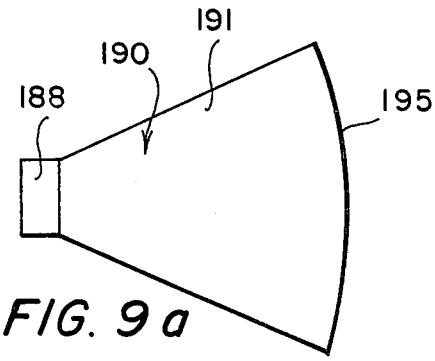
FIGS. 9*a* and 9*b* are diagrams showing a side elevation and an end view, respectiely, of a feed horn having planar walls and a rectangular cross section of increasing area and having another type of edge modification.
Figure 9B:
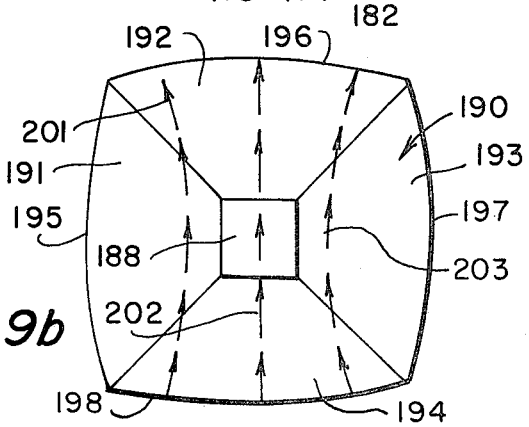

Another technique, suitable for the case of a symmetrical reflector, for crosspolarization compensation is shown in the embodiments of FIGS. 8*a* and 8*b* and FIGS. 9*a* and 9*b.* This technique involves modifications of feed horns which are of the flared horn type, i.e which have planar walls and whose cross section normal to the horn axis increases along the length of the horn. In FIGS. 8*a* and 8*b,* a rectangular waveguide 168 feeds a flared feed horn with rectangular cross section 170, having flat side walls 171, 172, 173 and 174. The required amount of crosspolarization compensation is introduced by modifying the forward edges of side walls 171, 172, 173 and 174. In particular, in the example of FIGS. 8*a* and 8*b,* the modification involves inwardly curving the forward edges as shown at 175, 176, 177 and 178. As seen in FIG. 8*b,* this results in polarization lines 181, 182 and 183 within the horn which will contribute the proper amount of direction of compensation for the crosspolarization components. If compensation of the opposite type is required, the modification shown in the embodiment of FIGS. 9*a* and 9*b* is employed. In FIGS. 9*a* and 9*b,* a rectangular waveguide 188 feeds a flared horn 190 with rectangular cross-section, having flat side walls 191, 192, 193 and 194. The forward edges of these walls are curved outwardly, as shown at 195, 196, 197 and 198 to provide the proper amount and direction of compensation. As shown in FIG. 9*b,* the polarization lines 201, 202 and 203 are bowed in a direction to provide compensation for crosspolarization components directed oppositely to those compensated for in the embodiment of FIGS. 8*a* and 8*b.*

In designing the feed horns of the invention, it has been found to be more effective to proceed empirically. Although an analytic approach is also possible, involving solutions of the Maxwell equations for given boundary conditions, it is difficult to take into account all side effects. When proceedig empirically, the magnitude of the crosspolarization component is checked for different configurations until the best result is obtained. In the case of the embodiment shown in FIG. 2*c,* this would involve adjustment of both wall shape and septa shape. Because the embodiment of FIG. 3 requires adjustment of the septa shape only, this embodiment is preferred as requiring a less complicated empirical procedure.

Tests of embodiments of the invention have verified a marked reduction in the size of the crosspolarization component. In particular, a first test using a feed horn of the prior art having no septa, such as the feed horn 30 shown in FIG. 2*b,* resulted in a signal having a crosspolarization component which had a measured power magnitude 22.2 dB below the measured power magnitude of the dominant polarization with an offset reflector. The test was then repeated using a feed horn with flat walls and shaped septa, as shown in FIG. 3. The crosspolarization component had a measured power magnitude of 29.5 dB below the measured power magnitude of the dominant polarization, demonstrating a 7.3 dB improvement by using shaped septa to compensate for the crosspolarization component.

The principles of the invention are applicable in all linearly polarized microwave radiating systems in which crosspolarization is a relevant factor. The invention will find utility, for example, in microwave point-to-point relay systems, radar systems with rain cancellation features for airport surveillance systems, and especially in satellite communication system antennas, both for ground and satellite equipment, where frequency reuse requires good polarization isolation. The invention may also be used in high performance test equipment antennas which are used for testing such systems.

Although the invention has been described with reference to particular embodiments, various changes and modifications which are obvious to a person skilled in the art to which the invention pertains are deemed to be within the spirit and scope of the invention as set forth in the appended claims.

The invention claimed is:

1. An antenna system, comprising:

a reflector;

at least a pair of feed horns located in the focal region of said reflector, said feed horns being positioned adjacent each other with the axis of each horn pointed at said reflector;

means for radiating beams in the same frequency band from said pair of feed horns at said reflector effective to reflect a pair of corresponding beams from said reflector; and compensation means incorporated in the structure of each of said feed horns, each of said compensation means being configured to alter the beam radiated from its feed horn in a manner which reduces crosspolarization components in the corresponding reflected beam, said reduction of crosspolarization components being effective to provide substantially linear polarization in said pair of reflected beams in mutually orthogonal directions.

2. An antenna system as recited in claim 1, wherein the axes of said feed horns are pointed toward the vertex region of said reflector.

3. An antenna system as recited in claim 1, wherein the axes of said feed horns are offset from the vertex of said reflector.

4. An antenna system as recited in claim 2 or 3, wherein said compensation means comprise mutually spaced septa positioned within each of said feed horns.

5. An antenna system as recited in claim 4, wherein said septa of each feed horn extend between one pair of opposite feed horn walls.

6. An antenna system as recited in claim 5, wherein at least some of said septa are curved.

7. An antenna system as recited in claim 6, wherein an odd number of septa extend between said pair of opposite feed horn walls including a substantially planar central septum, the septa on opposite sides of said planar central septum curving away from the latter.

8. An antenna system as recited in claim 7, wherein the cross section of each of said feed horns normal to said feed horn axis is substantially uniform throughout the length of each of said feed horns.

9. An antenna system as recited in claim 8, wherein each of said feed horns has planar walls and said cross section is rectangular throughout.

10. An antenna system as recited in claim 8, wherein said compensation means of each of said feed horns further comprises curved feed horn walls, said curved walls and septa of each feed horn being configured to cooperatively provide said substantially linearly polarized reflected beam.

11. An antenna system as recited in claim 10, wherein a first pair of opposite feed horn walls in each of said feed horns is convex and the second pair of opposite feed horn walls is concave.

12. An antenna system as recited in claim 3, wherein said compensation means of each of said feed horns comprises curved feed horn walls and mutually spaced, curved septa positioned within said feed horn and extending between one pair of opposite feed horn walls, said curved walls and septa of each feed horn being configured to cooperatively provide said substantially linearly polarized reflected beam and being asymmetric to correct for said offset.

13. An antenna system as recited in claim 2 or 3, wherein the cross section of each of said feed horns normal to said feed horn axis is substantially uniform throughout the length of said feed horn.

14. An antenna system as recited in claim 2 or 3, wherein the walls of each of said feed horns are planar throughout.

15. An antenna system as recited in claim 2 or 3, wherein the cross section of each of said feed horns normal to said feed horn axis increases along the length of said feed horn.

16. An antenna system as recited in claim 15, wherein each of said feed horn cross sections is rectangular.

17. An antenna system as recited in claim 16, wherein the walls of each of said feed horns are planar throughout.

18. An antenna system as recited in claim 17, wherein said compensation means of each of said feed horns comprises curved edges on said feed horn walls.

19. An antenna system as recited in claim 18, wherein said edges are curved convexly.

20. An antenna system as recited in claim 18, wherein said edges are curved concavely.

21. An antenna system, comprising:

a reflector;

a feed horn located in the focal region of said reflector, said feed horn being positioned with its axis pointed at said reflector;

means for radiating a beam from said feed horn at said reflector effective to reflect a beam from the latter, said radiated beam having a dominant linear polarization accompanies by spurious crosspolarization; and compensation means incorporated in the structure of said feed horn, said compensation means being configured to provide said radiated beam with a polarization modification adapted to reduce crosspolarization components in said reflected beam to an extent where said reflected beam is substantially linearly polarized.

22. An antenna system as recited in claim 21, wherein said feed horn axis is pointed toward the vertex region of said reflector.

23. An antenna system as recited in claim 21, wherein said feed horn axis is offset from the vertex of said reflector.

24. An antenna system as recited in claim 22 or 23, wherein said compensation means comprises mutually spaced septa positioned within said feed horn.

25. An antenna system as recited in claim 24, wherein said septa extend between one pair of opposite feed horn walls.

26. An antenna system as recited in claim 25, wherein at least some of said septa are curved.

27. An antenna system as recited in claim 26, wherein an odd number of septa extend between said pair of opposite feed horn walls including a substantially planar central septum, the septa on opposite sides of said planar central septum curving away from the latter.

28. An antenna system as recited in claim 27, wherein the cross section of said feed horn normal to said feed horn axis is substantially uniform throughout the length of said feed horn.

29. An antenna system as recited in claim 28, wherein said feed horn has planar walls and said cross section is rectangular throughout.

30. An antenna system as recited in claim 28, wherein said compensation means further comprises curved feed horn walls, said curved walls and septa being configured to cooperatively provide said substantially linearly polarized reflected beam.

31. An antenna system as recited in claim 30, wherein a first pair of opposite feed horn walls is convex and the second pair of opposite feed horn walls is concave.

32. An antenna system as recited in claim 23, wherein said compensation means comprises curved feed horn walls and mutually spaced, curved septa positioned within said feed horn and extending between one pair of opposite feed horn walls, said curved walls and septa being configured to cooperatively provide said substantially linearly polarized reflected beams and being asymmetric to correct for said offset.

33. An antenna system as recited in claim 22 or 23, wherein the cross section of said feed horn normal to said feed horn axis is substantially uniform throughout the length of said feed horn.

34. An antenna system as recited in claim 22 or 23, wherein the walls of said feed horn are planar throughout.

35. An antenna system as recited in claim 22 or 24, wherein the cross section of said feed horn normal to said feed horn axis increases along the length of said feed horn.

36. An antenna system as recited in claim 35, wherein said feed horn cross section is rectangular.

37. An antenna system are recited in claim 36, wherein the walls of said feed horn are planar throughout.

38. An antenna system as recited in claim 37, wherein said compensation means further comprises curved edges on said feed horn walls.

39. An antenna system as recited in claiim 38, wherein said edges are curved convexly.

40. An antenna system as recited in claim 38, wherein said edges are curved concavely.

* * * * *